US009839922B2

(12) United States Patent
Doak et al.

(10) Patent No.: US 9,839,922 B2
(45) Date of Patent: Dec. 12, 2017

(54) METHOD AND DEVICE OF PRODUCING AN INTERMITTENT LIQUID JET

(71) Applicants: Arizona Board of Regents, a body corporate of the State of Arizona, acting for and on behalf of Arizona State University, Scottsdale, AZ (US); Max-Planck-Gesellschaft zur Forderung der Wissenschaften e.V., Munich (DE)

(72) Inventors: Robert Bruce Doak, Tempe, AZ (US); Robert Shoeman, Heidelberg (DE); Sabine Botha, Heidelberg (DE); Ilme Schlichting, Munich (DE)

(73) Assignees: Arizona Board of Regents Acting for and on Behalf of Arizona State University, Scottsdale, AZ (US); Max-Planck-Gesellschaft Zur Foerderung Der Wissenschaften E.V., Munich (DE)

( * ) Notice: Subject to any disclaimer, the term of this patent is extended or adjusted under 35 U.S.C. 154(b) by 247 days.

(21) Appl. No.: 14/769,283

(22) PCT Filed: Mar. 13, 2014

(86) PCT No.: PCT/US2014/025249

§ 371 (c)(1),
(2) Date: Aug. 20, 2015

(87) PCT Pub. No.: WO2014/151231

PCT Pub. Date: Sep. 25, 2014

(65) Prior Publication Data

US 2016/0001305 A1 Jan. 7, 2016

Related U.S. Application Data

(60) Provisional application No. 61/789,294, filed on Mar. 15, 2013.

(30) Foreign Application Priority Data

Mar. 15, 2013 (EP) ..... 13001335

(51) Int. Cl.
*B05B 1/02* (2006.01)
*B05B 1/08* (2006.01)
(Continued)

(52) U.S. Cl.
CPC ..... *B05B 1/08* (2013.01); *B05B 1/02* (2013.01); *B05B 7/045* (2013.01); *B05B 7/0441* (2013.01);
(Continued)

(58) Field of Classification Search
CPC B05B 1/02; B05B 1/08; B05B 7/0441; B05B 7/045; B05B 7/0475; B05B 7/066; B05B 7/068; B05B 7/0815; B05B 12/06
See application file for complete search history.

(56) References Cited

U.S. PATENT DOCUMENTS 4,071,195 A 1/1978 Kuhns et al.
4,358,302 A 11/1982 Dahneke et al.
(Continued)

FOREIGN PATENT DOCUMENTS

EP 0647429 4/1995
WO 96/21516 7/1996
(Continued)

OTHER PUBLICATIONS

Extended European Search Report for PCT/US2014/024259, dated Nov. 18, 2016.
(Continued)

*Primary Examiner* — Ryan Reis
(74) *Attorney, Agent, or Firm* — McDonnell, Boehnen, Hulbert & Berghoff LLP

(57) ABSTRACT

Methods are provided for producing an intermittent liquid jet are provided that involve delivering a liquid through a gas dynamic nozzle, which includes an inner tube carrying the liquid, an outer tube carrying a focussing sheath gas, an exit channel and an exit aperture, injecting a stream of the liquid into the exit channel, wherein the liquid is enclosed by the focussing sheath gas in the exit channel, controlling emission of the liquid from the inner tube into the exit channel to produce a periodic, linear intermittent liquid jet including spurts of linear continuous jet sections separated by liquid-free gaps, and output of the intermittent liquid jet through the exit aperture. Furthermore, methods of scattering measurements on samples in a liquid using the method of producing an intermittent liquid jet and an injector device for producing an intermittent liquid jet are described.

14 Claims, 2 Drawing Sheets

(51) Int. Cl.

| | |
|---|---|
| ***B05B 7/04*** | (2006.01) |
| ***B05B 12/08*** | (2006.01) |
| ***B05B 12/06*** | (2006.01) |
| ***B05B 15/04*** | (2006.01) |

(52) U.S. Cl.
CPC ..... *B05B 7/0475* (2013.01); *B05B 12/06* (2013.01); *B05B 15/0431* (2013.01)

(56) References Cited

U.S. PATENT DOCUMENTS

| | | | | |
|---|---|---|---|---|
| 4,794,086 | A | 12/1988 | Kasper et al. | |
| 5,423,964 | A | 6/1995 | Smith et al. | |
| 5,464,157 | A | 11/1995 | Bourdoulous et al. | |
| 5,725,154 | A * | 3/1998 | Jackson | B08B 3/026 239/135 |
| 5,735,468 | A | 4/1998 | Casey | |
| 5,848,751 | A | 12/1998 | Wang et al. | |
| 5,962,606 | A | 10/1999 | Williams et al. | |
| 6,116,516 | A * | 9/2000 | Ganan-Calvo | A61M 15/0065 128/200.21 |
| 6,166,379 | A * | 12/2000 | Montaser | G01N 21/714 219/121.5 |
| 6,283,936 | B1 * | 9/2001 | Tavger | A61B 17/545 604/24 |
| 6,386,463 | B1 | 5/2002 | Ganan-Calvo et al. | |
| 6,478,240 | B1 | 11/2002 | Dorkin et al. | |
| 6,554,202 | B2 * | 4/2003 | Ganan-Calvo | A61M 15/0065 239/371 |
| 6,659,365 | B2 | 12/2003 | Gipson et al. | |
| 7,482,166 | B2 | 1/2009 | Nollert et al. | |
| 8,272,576 | B2 * | 9/2012 | Doak | B05B 7/0475 239/128 |
| 2001/0010206 | A1 | 8/2001 | Bryning | |
| 2003/0209666 | A1 | 11/2003 | Hirabayashi et al. | |
| 2008/0230053 | A1 * | 9/2008 | Kraft | A61M 11/06 128/200.23 |
| 2009/0025425 | A1 * | 1/2009 | Weinhold | B05B 7/045 65/21.2 |
| 2010/0243753 | A1 | 9/2010 | Doak et al. | |
| 2013/0313336 | A1 | 11/2013 | Doak et al. | |
| 2014/0263693 | A1 | 9/2014 | Doak et al. | |

FOREIGN PATENT DOCUMENTS

| | | |
|---|---|---|
| WO | WO 1999/030812 | 6/1999 |
| WO | WO 1999/030831 | 6/1999 |
| WO | WO 1999/030832 | 6/1999 |
| WO | WO 1999/030833 | 6/1999 |
| WO | WO 1999/030834 | 6/1999 |
| WO | WO 1999/030835 | 6/1999 |
| WO | WO 1999/031019 | 6/1999 |
| WO | WO 2001/045519 | 6/2001 |
| WO | WO 2001/069289 | 9/2001 |
| WO | WO 2000/076673 | 12/2001 |
| WO | WO 2002/047744 | 6/2002 |
| WO | WO 2002/060275 | 8/2002 |
| WO | WO 2005/018817 | 3/2005 |
| WO | WO 2006/117422 | 11/2006 |
| WO | WO 2009/091416 | 7/2009 |
| WO | 2011150368 A1 | 12/2011 |

OTHER PUBLICATIONS

Shapiro D.A et al, "Powder diffraction from a continuous microjet of submicrometer protein crystals", Journal of Synchrotron Radiation, vol. 15, pp. 593-599, 2008.

Howells M et al, "An assessment of the resolution limitation due to radiation-damage in X-ray diffraction microscopy", Journal of Electron Spectroscopy and Related Phenomena, vol. 170, Issue 1-3, pp. 4-12, 2009.

Ganan-Calvo A.M et al, "Generation of steady liquid microthreads and micron-sized monodisperse sprays in gas", Physical Review Letters, vol. 80, Issue 2, pp. 285, 1998.

Deponte D.P. et al, "Gas dynamic virtual nozzle for generation of microscopic droplet streams", Journal of Physics D: Applied Physics, vol. 41, Issue 19, pp. 1-7, 2008.

Ganan-Calvo A et al, "Focusing capillary jets closet to the continuum limit", Nature Physics, vol. 3, Issue 10, pp. 737-742, 2007.

International Search Report for PCT/US2012/065788, dated Jun. 21, 2013.

Deponte DP et al., "Towards ETEM serial crystallography: Electron diffraction from liquid jets", Ultramicroscopy , vol. 111, No. 7, pp. 824-827, 2011.

Hunter MS et al., "X-ray Diffraction from Membrane Protein Nanocrystals", vol. 100, Issue 1, Jan. 5, 2011, pp. 198-206.

Sharma R, "An environmental transmission electron microscope for in situ synthesis and characterization of nanomaterials", J. Mater. Res., vol. 20, No. 7, Jul. 2005, 1695-1701.

Lagrange T et al., "Nanosecond time-resolved investigations using the in situ of dynamic transmission electron microscope (DTEM)", Ultramicroscopy 108 (2008) 1441-1449.

Taylor KA et al., "Electron Microscopy of Frozen Hydrated Biological Specimens", Journal of Ultrastructureresearch 55, 448-456 (1976).

Unwin Pnt et al., "Molecular structure determination by electron microscopy of unstained crystalline specimens", Journal of Molecular Biology 94 (1975) 425-432.

Clark Gni et al., "The structure of ambient water", Molecular Physics, vol. 108, No. 11, Jun. 10, 2010, 1415-1433.

Rayleigh L, "On the instability of jets", Proceedings of the London Mathematical Society s1-10 (1878) 4-13.

International Search Report for PCT/US2014/025249, dated Aug. 26, 2014.

International Search Report for PCT/US2014/035627, dated Sep. 9, 2014.

Weierstall U et al., "Lipidic cubic phase injector facilitates membrane protein serial femtosecond crystallography", Nat Commun. 2014; 5: 3309.

Weierstall U et al., "Injector for scattering measurements on fully solvated biospecies", Review of Scientific Instruments 83, 035108 (2012).

* cited by examiner

METHOD AND DEVICE OF PRODUCING AN INTERMITTENT LIQUID JET

CROSS REFERENCE

This application is a U.S. national phase of International Application No. PCT/US2014/025249, filed Mar. 13, 2014, which claims priority to U.S. Provisional Application No. 61/789,294, filed Mar. 15, 2013, and to European Patent Application No. 13001335.2, filed Mar. 15, 2013, the disclosures of which are hereby incorporated by reference in their entireties.

BACKGROUND

Producing a microscopic contiguous free-stream liquid jet using a solid-walled convergent nozzle (so called "Rayleigh source") and break-up of the liquid jet into a linear stream of almost monodisperse droplets (so called "Rayleigh-Plateau break-up") are generally known. The ability to trigger the Rayleigh-Plateau break-up by imposing a dominant acoustic drive signal has been documented e. g. by U. Weierstall et al. in "Exp. Fluids" vol. 44, 2008, p. 675-689. The triggered break-up results in a perfectly periodic, monodisperse, and linear stream of droplets. Either the contiguous section of the liquid jet or the droplet stream can be employed for experimental/process use, depending on the demands of the experiment/process at hand. However, Rayleigh sources may have disadvantages in terms of clogging of the solid-walled convergent nozzle, making it impossible to reliably generate liquid jets of smaller than about 20 μm in diameter (yielding droplets of 40 μm diameter). This is far too large e. g. for X-ray scattering experiments with biological samples suspended in liquids. Furthermore, the large jet diameter results in an undesirably large sample consumption.

Furthermore, a microscopic contiguous linear liquid free-stream jet can be produced using a sheath gas stream (see e. g. A. M. Gañán-Calvo in "Phys. Rev. Lett." vol. 80, 1998, p. 285-288: or U.S. Pat. No. 8,272,576). The sheath gas stream is provided by a so-called gas dynamic nozzle (or: Gas Dynamic Virtual Nozzle, GDVN) as disclosed in U.S. Pat. No. 8,272,576. The gas dynamic nozzle includes an inner tube carrying a liquid, an outer tube carrying the focussing sheath gas, an exit channel and an exit aperture. As with Rayleigh sources, the contiguous liquid jet presents a Rayleigh-Plateau break-up into a linear stream of droplets (see e. g. D. P. DePonte et al, in "J. Phys. D: Appl. Phys." vol. 41, 2008. p. 195505-195512).

With the gas dynamic nozzle technique, the liquid jet is continuously formed with a "virtual nozzle" created by the convergent sheath gas rather than by a convergent solid-walled nozzle. As a result, the GDVN injectors are much less susceptible to clogging. Furthermore, GDVN injectors may be used to routinely produce liquid jets having a diameter of 5 μm (Yielding droplets of about 10 μm diameter after break-up, which is significantly smaller than the clogging-limited droplet size of a Rayleigh source). By placing the exit of the timer tube very nearly at or even beyond the end of convergent sheath gas flow, where the gas is actually expanding as a free-jet expansion, even smaller free-streams can be delivered, e. g. having a diameter as small as 300 nm (600 nm droplets after Rayleigh break-up), see A. M. Gañán-Calvo in et al. in "small" vol. 6, 2010, p. 822-824.

Despite this jet diameter reduction, liquid jets conventionally produced with gas dynamic nozzles may have a disadvantage resulting from the continuous flow nature of the liquid jet and the resulting continuous substance consumption since, as an example, precious biological samples often are available in amounts measured in tens of μl only. If such biological samples suspended in a liquid are to be investigated by measuring X-ray scattering at a continuous flow liquid jet of the suspension and the liquid jet has a flow rate of about 10 to 20 μl/min the measuring time or number of measurements are strongly limited. This problem is even intensified by the fact that measurements often are conducted with pulsed probe beam sources. Large portions of the continuous flow liquid jets then cannot be utilized for the measurements as they are not hit by probe beam pulses.

As a further disadvantage of gas dynamic nozzles, it has been found that an irregular "dripping" behaviour of gas-focused liquid jets may occur (see e. g. J. M. Montanero et al. in "Phys. Rev. E" vol. 83, 2011, p. 036309: E. J. Vega et al. in "Phys. Fluids." vol. 22, 2010, p. 064105; and T. Si et al. in "J. Fluid Mech." vol. 629, 2009, p. 1-23, and in "Phys. Fluids" vol. 22, 2002. p. 112105). The dripping behaviour is an undesirable mode of operation as samples are provided in an irregular and non-reproducible fashion. Therefore, the above investigations have been conducted for characterizing the transition from the dripping to the jetting mode of the nozzle in order to avoid the dripping behaviour.

Another conventional technique of delivering small amounts of liquids for a measurement uses "droplet-on-demand" injectors (DoD injectors), which are operated in vacuum. However, these DoD injectors have a disadvantage resulting from evaporative cooling in vacuum, causing the nozzle to freeze shut between droplets. Heating the DoD injector nozzle to prevent freezing is problematic for most biological molecules, which invariably denature at just above body temperature.

SUMMARY OF THE INVENTION

The present invention relates to a method of producing a liquid jet using a gas dynamic nozzle. Furthermore, the present invention relates to a method of scattering measurements on samples included in a liquid jet. Furthermore, an injector device for producing a liquid jet is described. Applications of the invention are available with physical or chemical liquid handling procedures, in particular with the provision of samples in liquids for measuring purposes and/or chemical reactions.

In one aspect, the invention provides methods of producing an intermittent liquid jet, comprising the steps of:

- delivering a liquid through a gas dynamic nozzle, which includes an inner tube carrying the liquid, an outer tube carrying a focussing sheath gas, an exit channel and all exit aperture,
- injecting a stream of the liquid into the exit channel, wherein the liquid is enclosed by the focussing sheath gas in the exit channel,
- controlling emission of the liquid from the inner tube into the exit channel to produce a periodic, linear intermittent liquid jet including spurts of linear continuous jet sections separated by liquid-free gaps, and
- output of the intermittent liquid jet through the exit aperture.

In one embodiment, the methods may include the step of setting at least one of a duration of the continuous jet sections, a length of the continuous jet sections, a diameter of the continuous jet sections, a duration of the liquid-free gaps, a length of the liquid-free gaps, and a spurt repeat period T. In a further embodiment, the methods may include at least one of the features the duration of the continuous jet sections is less than 10% of the spurt repetition period T, the length of the continuous jet sections is less than 10% of v*T, where v is a terminal speed of the linear liquid jet, the diameter of the continuous jet sections is below 10 μm, the duration of the liquid-free gaps is greater than 90% of the spurt repetition period T, the length of the liquid-free gaps is greater than 90% of v*T, and the spurt repeat period T is matched to a pulse rate of a separate pulsed probe beam.

In a further embodiment, the controlling step may include at least one of tuning a liquid flow rate of the liquid in the inner tube, tuning a liquid pressure of the liquid in the inner tube, tuning a sheath gas flow rate of the sheath gas in the outer tube, tuning a sheath gas pressure of the sheath gas in the outer tube, providing an inner diameter of the inner tube, providing an axial length of the exit channel, providing a diameter of the exit aperture, and providing an acoustic, optical, or electromagnetic pulse to initiate emission of the liquid spurts from the inner tube.

In a further embodiment, the methods may include at least one of the features the liquid flow rate is below 1 μl/min, the liquid pressure is below 6000 psi, absolute, the sheath gas pressure is at between 10 and 3000 psi, the inner diameter of the inner tube is at least 10 μm, the inner diameter of the inner tube is at most 100 μm, the diameter of the exit aperture is at least 10 μm, the diameter of the exit aperture is at most 100 μm, the axial length of the exit channel is at least equal to the diameter of the exit aperture, the axial length of the exit channel is at most twenty times larger than the diameter of the exit aperture, the liquid jet emerges into ambient gas at one atmosphere pressure, the liquid jet emerges into near-vacuum at much less than atmospheric pressure, the gas flows at supersonic speed downstream of the exit aperture, and the gas flows at subsonic speed downstream of the exit aperture.

In a still further embodiment, the methods may include the steps of monitoring the liquid in the exit channel or after leaving the exit aperture and providing a monitoring output. In another embodiment, the controlling step may be conducted in dependency on the monitoring output.

In one embodiment, the controlling step may include an application of acoustic, optical, or electromagnetic pulses triggering the production of the intermittent liquid jet.

In another aspect, the invention provides methods of scattering measurements on samples in a liquid, comprising the steps of:

producing an intermittent liquid jet including spurts of continuous jet sections with a method according to any embodiment or combination of embodiments of the methods of producing an intermittent liquid jet of the invention, irradiating the continuous jet sections or parts thereof with pulses of a probe beam, and measuring scattering of the probe beam from the continuous jet sections or parts thereof.

In one embodiment, the methods may include measuring at least one of the intensity, the energy spectrum and the momentum spectrum of emissions from the intermittent liquid jet resulting from irradiation with the probe beam, including emission of electrons, ions, atoms, and electromagnetic radiation. In another embodiment, the intermittent liquid jet and the probe beam pulses are controlled such that each single continuous jet section is irradiated by a single probe beam pulse or by a defined train of multiple probe beam pulses. In a further embodiment, the methods may include a step of controlling a relative phase of the intermittent liquid jet and the probe beam pulses. In a still further embodiment, the relative phase of the intermittent liquid jet and the probe beam pulses are controlled by at least one of tuning a liquid flow rate of the liquid in the inner tube of the gas dynamic nozzle and applying an acoustic, optical, or electromagnetic pulse to the liquid jet.

In another embodiment, the continuous jet sections are irradiated with the pulses of the probe beam in a region of delivery, and the region of delivery is immediately downstream of the exit aperture, where the continuous jet sections have a contiguous cylindrical form, or the region of delivery is downstream with a distance from the exit aperture, where the continuous jet sections have undergone a Rayleigh-Plateau breakup into a linear stream of droplets.

In a further aspect, the invention provides injector devices for producing an intermittent liquid jet, comprising:

a gas dynamic nozzle, which includes an inner tube carrying a liquid, an outer tube carrying a focussing sheath gas, an exit channel and an exit aperture, and a control device arranged for tuning at least one of a liquid flow rate of the liquid in the inner tube, a liquid pressure of the liquid in the inner tube, a sheath gas flow rate of the sheath gas in the outer tube, and a sheath gas pressure of the sheath gas in the outer tube.

In one embodiment, the injector device may include a trigger device being adapted for applying an acoustic, optical, or electromagnetic pulse to the injector device.

DETAILED DESCRIPTION OF THE INVENTION

Figure 1:
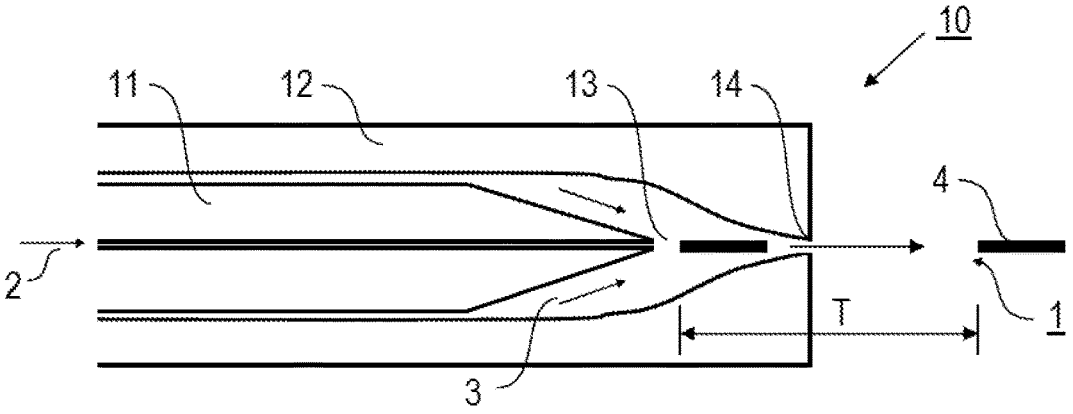
FIG. 1 is a schematic cross-sectional view of a gas dynamic nozzle used for creating an intermittent liquid jet according to the invention.

As used herein, the singular forms "a", "an" and "the" include plural referents unless the context clearly dictates otherwise. "And" as used herein is interchangeably used with "or" unless expressly stated otherwise. All embodiments of any aspect of the invention can be used in combination, unless the context clearly dictates otherwise.

Unless the context clearly requires otherwise, throughout the description and the claims, the words 'comprise', 'comprising', 'include', including', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

It is an objective of the invention to provide an improved method of producing a liquid jet that is capable of avoiding limitations of conventional techniques. In particular, the method of producing a liquid jet is to be improved with regard to a controllability of liquid jet flow properties, a reproducibility of liquid supply, e. g. for measurements, and/or with regard to a reduced liquid consumption. It is a further objective of the invention to provide an improved method of scattering measurements on samples included in a liquid jet, being capable of avoiding disadvantages of conventional measuring techniques. In particular, the method of scattering measurements is to be capable of reducing undesirable sample lost during a probe beam irradiation. It is yet a further objective of the invention to provide an improved injector device configured for producing a liquid jet, being capable of avoiding disadvantages of conventional injector devices. In particular, the injector device is to be capable of providing additional degrees of freedom in controlling of liquid jet flow properties and/or allowing a reduced liquid consumption.

These objectives are solved with method of producing a liquid jet, a method of scattering measurements on samples included in a liquid jet and an injector device comprising the features of the independent claims. Preferred embodiments of the invention are defined in the dependent claims.

According to a first general aspect of the invention, a method of producing an intermittent liquid jet is provided, which comprises a step of delivering a liquid through a gas dynamic nozzle, which includes an inner tube (inner capillary) carrying the liquid, an outer tube carrying a focussing sheath gas, an exit channel and an exit aperture. A stream of the liquid is emitted from the inner tube into the exit channel, where the liquid is enclosed by the focussing sheath gas. In the exit channel, a liquid jet is formed, which is supplied through the exit aperture. According to the invention, the emission of the liquid from the inner tube into the exit channel is controlled such that a periodic, linear intermittent liquid jet is produced. The intermittent liquid jet consists of spurts of linear continuous jet sections separated by liquid-free gaps. The term "spurt" refers to limited-duration linear liquid GDVN free-stream jet portions with a longitudinal extension along the jet flow direction. Contrary to the conventional gas dynamic nozzle techniques, the emission of the liquid from the inner tube is not continuous, but periodically interrupted. The spurts of continuous jet sections are straight portions of the liquid which are created in the exit channel with a predetermined period (spurt repeat period). Finally, the intermittent liquid jet is output through the exit aperture.

The inventors have found that the operation conditions of the gas dynamic nozzle, i. e. flow parameters of the liquid, in particular the flow rate thereof, and/or the sheath gas and/or geometric parameters of the gas dynamic nozzle, can be adjusted in a targeted fashion so that the spurts of continuous jet sections are created in the exit channel. Based on the spurts, a controllable and usable pulsed mode of nozzle operation has been demonstrated. Experimental investigations by the inventors, in particular using a high speed camera, have shown that it is the formation and growth of a convex bulbous meniscus of the liquid at the distal end of the inner tube and its sudden transition from a bulbous shape to the cusp-like meniscus of gas dynamic nozzle operation that leads to emission of each spurt.

Advantageously, the invention provides a methodology for reproducible pulsed injection of liquids, containing e. g. fully solvated microscopic biological samples, into vacuum or an atmosphere surrounding the nozzle. In contrast to continuous flow techniques employed to date, this intermittent flow method reduces the consumption of sample solution by up to two orders of magnitude, enabling investigation of e. g. biological samples that are available only in minute quantities. The methodology is particularly relevant to the study of macromolecules, macromolecular assemblies, viruses or nanocrystals formed from such species, by use of X-Ray Free Electron Lasers (XFEL).

The inventors have shown with the use of high speed photographic studies that contrary to the conventional "dripping" mode a highly reproducible formation and termination of a liquid meniscus in a gas dynamic nozzle can be provided as a physical. basis for intermittent operation of the gas dynamic nozzle. The measurements by the inventors on nozzles of different geometry (in particular different inner tube bore and length of the exit channel) show that the intermittent operation of the gas dynamic nozzle can be controlled as a dominant and stable nozzle behavior. The inventors also have shown that the exact attributes of intermittent operation of the gas dynamic nozzle (in particular speed, length, diameter, and duration of the liquid free-stream, spurt repeat interval) can be set and fine-tuned by choice of the nozzle geometry and/or of the gas and liquid flow rates and pressures. Preferably, the control includes a regulation of the liquid flow rate, as this influences the basic nozzle ejection period. Repeat intervals from many ins down to tens of is are possible. Of particular interest are embodiments with a low flow rate of the liquid, which preferably is below 500 nl/min, in particular below 300 nl/min e. g. 200 nl/min or even lower. At 200 nl/min it is a factor of ×50 to ×100 lower than that of a conventional continuous-flow GDVN liquid jet. Given that many biological samples of great interest are available only in minute amounts, a reduction of this magnitude shows the tremendous advantages for any applications—such as experimental investigations at the Linac Coherent Light Source (LCLS, Stanford, USA), where the sample is probed only intermittently. Also of interest for engineering design of an intermittent GDVN injector is the inventor's observation of the role played by sheath gas flow rate in the spurt ejection process.

According to a second general aspect of the invention, a method of scattering measurements on samples in a liquid is provided, which includes the step of producing an intermittent liquid jet including spurts of continuous jet sections with a method according to the above first aspect of the invention. Furthermore, after leaving the exit aperture, continuous jet sections are irradiated with pulses of a probe beam (radiation beam) resulting in a scattering process of the probe beam with the liquid or a contents thereof, e. g. sample molecules included in the liquid. The probe beam comprises e. g. an emission from an X-Ray Free Electron Laser. Finally, the scattered probe beam is measured using a detector device.

According to a third general aspect of the invention, an injector device is provided. for producing an intermittent liquid jet which comprises a gas dynamic nozzle including an inner tube carrying the liquid, an outer tube carrying a focussing sheath gas, an exit channel and an exit aperture, and a control device arranged for tuning at least one of a liquid flow rate of the liquid in the inner tube, a liquid pressure of the liquid in the inner tube, a sheath gas flow rate of the sheath gas in the outer tube, and a sheath gas pressure of the sheath gas in the outer tube.

The injector device can be based on a gas dynamic nozzle with a basic structure and function as it is known from conventional techniques which are equipped with the control device. Thus, the gas dynamic nozzle can immediately be switched from intermittent to continuous flow at any time. Flow switching can be performed with the control device e. g. using remotely controlled pumps, valves and/or gas regulators.

According to a preferred embodiment of the method according to the above first aspect of the invention, the controlling step includes a step of setting jet parameters of the intermittent liquid jet, in particular including a duration of the continuous jet sections, a length of the continuous jet sections, a diameter of the continuous jet sections, a duration of the liquid-free gaps, a length of the liquid-free gaps, and/or the spurt repeat period. Advantageously, the jet parameters can be selected in dependency on the requirements of a particular application of the invention, e. g. by setting a flow rate of the liquid and/or the sheath gas and/or by selecting an inner tube with an appropriate inner diameter.

Preferably, the duration of the continuous jet sections is less than 10%, in particular less than 5% of the spurt repetition period. Correspondingly, the duration of the liquid-free gaps preferably is greater than 90% of the spurt repetition period. According to a further preferred variant, the length of the continuous jet sections is less than 10% (or the length of the liquid-free gaps is greater than 90%) of the product of the spurt repetition period and a terminal speed of the linear liquid jet at the exit of the inner tube. Furthermore, the diameter of the continuous jet sections can be set to be below 10 μm, in particular below 5 μm. Advantageously, these alternative parameters which can be provided in combination, allow a reduction of the substance consumption at least by a factor of 10, compared with conventional techniques.

According to a preferred embodiment of the method according to the above second aspect of the invention, the spurt repeat period is matched to a pulse rate of the pulsed probe beam. The flow parameters of the intermittent liquid jet can be selected such that a single continuous jet section is supplied to a region of delivery only during the irradiation with the probe beam. Preferably, the intermittent liquid jet and the probe beam pulses are controlled such that each single continuous jet section is irradiated by a single probe beam pulse or by a defined train of multiple probe beam pulses. As an example, the European XFEL will produce trains of 2700 X-ray pulses spaced 200 ns apart (600 μs per train). The trains will be spaced 0.1 s apart. The inventive control allows to illuminate a single spurt with the entire train.

Additionally or alternatively, a relative phase of the intermittent jet of the liquid, i. e. the time of arriving in a region of delivery, and the probe beam pulses can be controlled. Preferably, the relative phase of the intermittent liquid jet and the probe beam pulses is controlled by tuning the liquid flow rate of the liquid in the inner tube of the gas dynamic nozzle and/or by applying an acoustic, optical, or electromagnetic trigger pulse to the liquid jet.

Advantageously, multiple variants of implementing the controlling step are available with preferred embodiments of the invention, which can be realized separately or in combination. According to first variants, the controlling step includes a timing of the liquid flow rate, e. g. below 1 μl/min, and/or the liquid pressure, e. g. between 0 psi and 6000 psi, of a liquid pump providing the liquid in the inner tube (1 psi=6894.75 Pa). In this case, the control device of the inventive injector device preferably includes a controllable pump, e. g. a HPLC pump, optionally combined with a liquid pressure amplifier.

According to further variants, the controlling step includes a tuning of the sheath gas flow rate and/or the sheath gas pressure, e. g. between 10 and 3000 psi, in particular below 1000 psi, of a gas source providing the sheath gas in the outer tube. The gas source is e. g. a tank of compressed gas, optionally combined with a gas compressor. Thus, the control device of the injector device preferably comprises a controllable valve connected between a pressure gas source and the as dynamic nozzle. Depending on the application of the invention, the sheath gas may flow at supersonic speed or subsonic speed downstream of the exit aperture.

According to yet further variants, the controlling step may include a provision of geometric parameters of the as dynamic nozzle. This can be done e. g. by selecting a particular nozzle or by exchanging parts of the nozzle for a scattering measurement to be conducted. Geometric parameters of the gas dynamic nozzle preferably comprise an inner diameter of the inner tube, e. g. at least 10 μm and/or at most 100 μm, an axial length of the exit channel, and/or a diameter of the exit aperture, e. g. at least 10 μm and/or at most 100 μm. The axial length of the exit channel preferably is at least equal to the diameter of the exit aperture, and the axial length of the exit channel preferably is at most twenty times larger than the diameter of the exit aperture.

As a further advantage of the invention, the gas dynamic nozzle can be operated with various ambient conditions while keeping the stable production of the intermittent liquid jet. Generally, the intermittent gas dynamic nozzle operation is fully compatible with injection into vacuum, which is the preferred mode of conventional LCLS operations. In particular, all measurements conducted by the inventors were made during injection into vacuum even though (as was explicitly verified) all of the tested gas dynamic nozzles were also capable as well of injection into ambient air. The inventive method of intermittent injection therefore has great advantages over the conventional DoD injectors, as the freezing is not a problem with gas dynamic nozzle injectors due to the gas flow that surrounds the liquid stream until beyond the point of injection into vacuum.

According to a further preferred embodiment of the invention, the emission of the liquid from the inner tube into the exit channel can be controlled by a trigger action. The production of the spurts of continuous jet sections can be triggered, preferably by providing an acoustic, optical, and/or electromagnetic trigger pulse. The trigger pulse is adapted for initiating the emission of a liquid spurt from the inner tube. The trigger control according to this embodiment of the invention has particular advantages for precise synchronization of the spurt production with the pulsed probe beam illumination in the region of delivery. The emission of the intermittent liquid spurt can be periodically initiated at very well defined points in time.

According to a yet another preferred embodiment of the invention, the liquid is monitored in the exit channel or after leaving the exit aperture of the gas dynamic nozzle. A monitoring device, which comprises e. g. a camera, provides a monitoring output signal. Advantageously, the monitoring output signal can be used for characterizing the intermittent liquid jet production in the gas dynamic nozzle. With a particularly preferred embodiment of the invention, the controlling step can be conducted in dependency on the monitoring output signal, i. e. a control loop can be implemented, wherein operations parameters and/or geometric parameters of the gas dynamic nozzle are adjusted in dependency on the monitoring output signal.

According to further preferred embodiments of the method according to the above second aspect of the invention, at least one of the intensity, the energy spectrum and the momentum spectrum of emissions from the intermittent liquid jet is measured which results from the irradiation with the probe beam. Depending on the application of the invention, these emissions may include e. g. electrons, ions, atoms, and electromagnetic radiation.

With the method according to the above second aspect of the invention, the continuous jet sections are irradiated with the pulses of the probe beam in a predetermined region of delivery of the continuous jet sections. The region of delivery is a region within a measuring apparatus where the pulses of the probe beam pass, possibly with a focussed beam. The region of delivery can be selected in dependency on the particular application requirements, e. g. immediately downstream of the exit aperture, where the continuous jet sections have a contiguous cylindrical form. Alternatively, as the continuous jet sections are subjected to the above Rayleigh-Plateau like the conventional continuous liquid jets, the region of delivery can be located downstream with a distance from the exit aperture, where the continuous jet sections have undergone a Rayleigh-Plateau breakup into a linear stream of droplets.

Further details and advantages of the invention are described in the following with reference to the attached drawings.

Preferred embodiments of the invention are described in the following with particular reference to the control of a gas dynamic nozzle for obtaining an intermittent liquid jet according to the invention. While examples of preferred operation conditions of the gas dynamic nozzle are described, it is emphasized that the implementation of the invention is not restricted to the disclosed examples. With the physical basis of the meniscus formation/termination process in a gas dynamic nozzle understood, a variety of engineering designs are possible for an injector based on inventive intermittent gas dynamic nozzle operation. The gas dynamic nozzle used for implementing the invention can be fabricated as described with conventional gas dynamic nozzles. Geometric parameters of the gas dynamic nozzle can be selected for controlling the intermittent liquid jet operation by the skilled user on the basis of test experiments and numerical simulations. The gas dynamic nozzle is shown with a horizontal jet flow direction. The invention is not restricted to this example. A vertical jet flow direction or other directions can be provided as well. Applications of the invention, in particular details of preparing biological samples or details of scattering measurements are not described as far as they are known from conventional scattering measurements.

FIG. 1 shows an enlarged cross-sectional view of a downstream end of a gas dynamic nozzle 10 including an inner tube 11, an outer tube 12, an exit channel 13 and an exit aperture 14. The inner tube 11 and the outer tube 12 are connected with a liquid reservoir and a gas pressure source (not shown), resp., and with parts of the control device (not shown) as described with further details with reference to FIG. 3 below.

The inner tube 11 is a capillary with an inner channel accommodating a flow of the liquid 2 to be delivered as an intermittent liquid jet 1. The capillary is coaxially arranged within the outer tube 12 so that a spacing is formed which accommodates a flow of the focussing sheath gas 3. The downstream end of the outer tube 12 is closed with a wall presenting the exit aperture 14 which is aligned with the axial direction of the inner channel of inner tube 11. At the exit aperture 14, the nozzle opens towards an adjacent space, e. g. a measuring space of an apparatus for scattering measurements. The adjacent space may be evacuated. The path between the downstream end of the inner tube 11 and the exit aperture 14 provides the exit channel 13, which has a profile converging towards the exit aperture 14.

The gas dynamic nozzle 10 can be fabricated following the procedure of U. Weierstall et al. in "Rev. Sci. Instrum." vol. 83, 2012, p. 035108. Specifically, a square borosilicate capillary (Friederich & Dimmock BMC-040-15-50, 400 μm inner by 600 μm outer dimension) is employed as the outer tube 12 and a Polymicro silica capillary TSP020375 or TSP050375 (360 μm outer dimension by 20 or 50 μm inner dimension) as the inner tube 11. The end of the outer tube 12 is flame-burnished to form a converging aperture, ground back to a flat exit plane, then glued into a 1/16 in outer dimension×0.040 in inner dimension by 5 cm long stainless steel tube (Upchurch U-138) (1 in=2.54 cm). In order to form an end shape with the exit aperture 14 as symmetrical as possible, the flame-forming is carried out while rotating the square tubing at several rotations per second about its axis. To allow a clear view of the meniscus region at the end of the inner tube 11. the front end of the burnished was not ground to a conical shape as is the usual practice in fabricating nozzles for LCLS experiments (the intent of the cone being to avoid obstructing X-rays scattered to high angles). The inner tube 11 is coned on its outer front end (downstream end) and inserted as far as possible into the square outer tube 12. This automatically centers the capillary within the tube while still providing ample cross-sectional area on the four corners to pass adequate gas flow for gas dynamic nozzle action. For practical tests, the gas dynamic nozzle 10 is mounted in a test chamber connected with a vacuum pump and having optically flat. O-ring sealed windows to provide viewing ports on each of the four sides.

The intermittent liquid jet 1 is created by delivering the liquid 2 through the gas dynamic nozzle 10. The liquid 2 is driven using a controllable HPLC pump (e. g. from manufacturer Shimadzu). Spurts of linear continuous jet sections 4 are periodically formed with a spurt repeat period T. Liquid-free gaps are present between the continuous jet sections 4.

Figure 2:
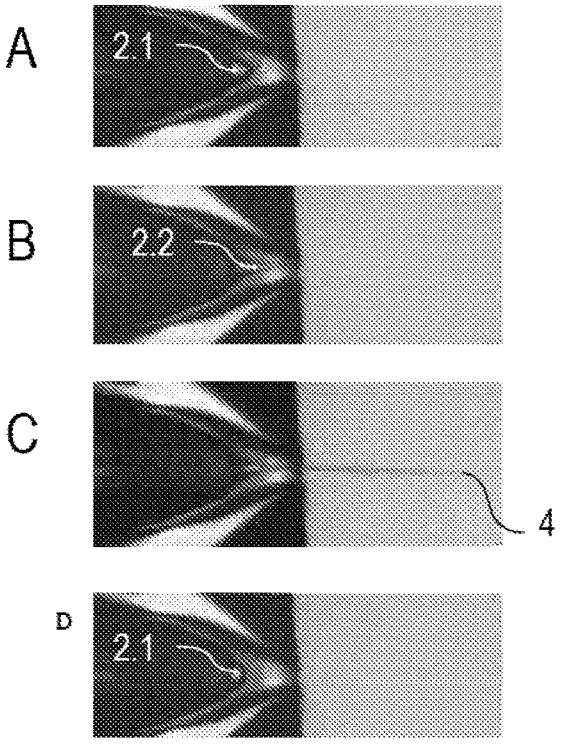
FIG. 2 shows experimental results showing the spurt formation of a linear continuous jet section according to the invention.

FIG. 2 shows selected pictures from a series of photographs recorded at different phases of the emission of the liquid 2 from the inner tube 11 and the creation of the spurts of linear continuous jet sections 4. The photographs have been collected using high speed photography with a Photon Fastcam camera equipped with a Navitar high magnification zoom lens in combination with a LCD fiber optic illuminator, e. g. illuminator type Schott 1500. The operation of the gas dynamic nozzle 10 was examined in detail at high spatial resolution and at frame rates of up to 500,000 frames/s (2 μs between frames). With the tested example, the liquid is water, flowing at a nominal volumetric rate of 200 nl/min and generating spurts at 10.5 ms spurt repeat periods.

According to FIG. 2A, a hemispherical droplet 2.1 (bulb) is formed at the downstream end of the inner tube 11. With the emission of further liquid, the bulb 2.1 slowly elongates into a more bulbous shape, then suddenly "snaps" from its bulbous convex shape into a cusped gas dynamic nozzle meniscus shape 2.2, forming a liquid jet (FIGS. 2B, 2C) that appears to have all the properties of the usual continuous-flow GDVN jet. A continuous jet section 4 of the linear jet is emitted from the bulb 2.1 under the effect of the flow of sheath gas. The sheath gas is e. g. helium gas with a pressure of 300 psi. Liquid flows through the meniscus for 30 to 50 μs, with the diameter of the liquid stream slightly decreasing over this time. The gas dynamic nozzle meniscus 2.2 then suddenly snaps back into its original hemispherical shape and size. With a certain spurt length, the continuous jet section 4 breaks away from the upstream liquid flow, so that the bulb 2.1 remains at the downstream end of the inner tube 11, while the continuous jet, section 4 is output through the exit aperture 14 (FIG. 2D, FIG. 1). Subsequently, another continuous jet section 4 is emitted from the bulb.

With more details, the photographs of FIG. 2 demonstrate the feasibility of intermittent injection into vacuum of a microscopic linear liquid free-stream from the gas dynamic virtual nozzle 10. After the brief initial "turn-on" transient of about 10 μs, the intermittent stream appears to have all of the same advantageous attributes as that from a continuous-flow GDVN (see U.S. Pat. No. 8,272,576). However, the flow remains "on" for only a few tens of μs, whereafter the flow terminates abruptly and cleanly when operating in the inventive flow regime. The duration ("on time") of the liquid stream does not exceed a few tens of is and this can be varied by tailoring the geometry of the gas dynamic nozzle 10 (in particular bore diameter of inner tube 11 and distance of this inner tube's exit from exit aperture 14). This alters the dimensions of the GDVN meniscus and thereby the "on time" duration. The time between liquid stream emissions ("off time") varies much more dramatically and depends on both the pressure applied to the liquid 2 in the inner tube 11 as well as the pressure applied to the coaxially flowing sheath gas 3 in the outer tube 12.

The inventors have demonstrated "off times" ranging from a few tens of μs up to over 10 ms. The latter are achieved at very low liquid flow rates. At 200 nl/min, for example, with no pressure applied to the liquid and 300 psi on the sheath gas 3, the gas dynamic nozzle 10 of 50 μm bore inner tube 11 emits water streams every 10.5 ms. The usable duration of these intermittent liquid free-streams is about 35 μs and the usable. stream length is about 350 μm. These attributes are ideally suited to intermittent delivery of sample-containing liquid streams at the repetition rate of the SLAC Linac Coherent Light Source (LCLS), namely at 120 Hz (pulse-to-pulse separation of 8.33 ms). LCLS measurements made in this intermittent mode of operation would be indistinguishable from those made with a continuous-flow GDVN stream. However the much lower flow rate (200 nl/min as opposed to the usual 10 to 20 μl/min of a conventional continuous GDVN stream) offers an extraordinary advantage for measurements with precious biological samples.

The inventive creation of the spurts of continuous jet sections in the exit channel is adjusted on the basis of the following results of the inventors: (1) the turn-off spurts are in fact highly structured and very reproducible, (2) gas dynamic nozzle turn-on and turn-off is intimately connected to the appearance and disappearance of the cusped GDVN meniscus, (3) there is hysteresis in the turn-on and turn-off, providing an "on time" that depends primarily on the fluid dynamics of the meniscus formation, specifically on the size and volume of the gas dynamic nozzle meniscus (once formed), on the sheath gas speed, and on the inflow of liquid into the meniscus, and (4) once the gas dynamic nozzle meniscus is formed, it emits a linear liquid free-stream of microscopic diameter, essentially identical to that produced by a continuous-flow gas dynamic nozzle.

Furthermore, the inventors have found an oscillation of the drop at the front of the inner tube 11 after the meniscus "snaps back" into the hemispherical shape 2.1. The details of this oscillation depend on the geometry of the gas dynamic nozzle meniscus: if the meniscus is axially symmetric, then so too are the oscillations. If the meniscus is not axially symmetric, then the oscillations contain as well an off-axis rotational component. In any event, the oscillations damp out after a few tens of microseconds. The drop then re-fills and the process repeats. It is highly reproducible from one spurt to the next. For the creation of the spurts of continuous jet sections, the gas dynamic nozzle 10 can be controlled such that these oscillations of the bulb-shaped drop appear at the downstream end of the inner tube 11.

Figure 3:
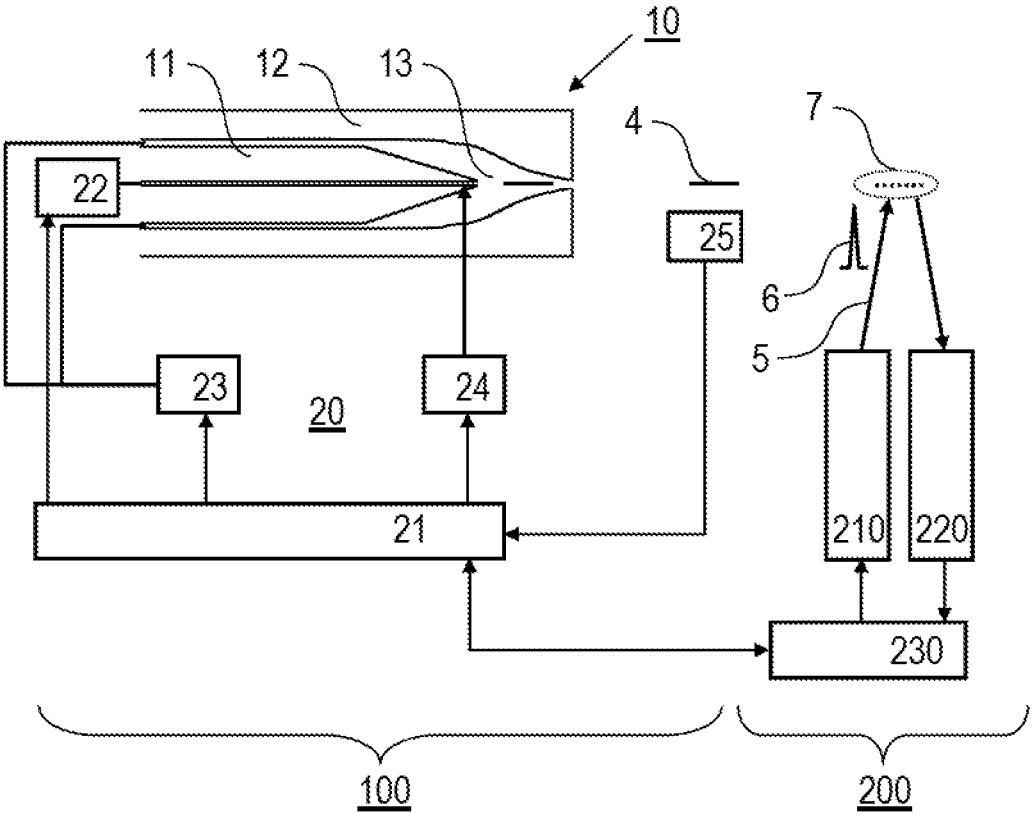
FIG. 3 is a schematic view of a measuring apparatus including a gas dynamic nozzle for creating an intermittent liquid jet according to the invention.

FIG. 3 schematically illustrates an embodiment of an injector device 100 according to the invention. The injector device 100 includes the inventive gas dynamic nozzle 10 and a control device 20. As described with reference to FIG. 1, the gas dynamic nozzle 10 comprises an timer tube 11, an outer tube 12, an exit channel 13 and an exit aperture 14. The control device 20 comprises a timing unit 21, such as a microcontroller, which is connected with a controllable liquid pump 22, with a controllable sheath gas reservoir 23 and—optionally—with a trigger device 24. With the liquid pump 2:2, like e. g. a HPLC pump, the liquid 2 is carried from a liquid reservoir (not shown) through the inner tube 11. The sheath gas reservoir 23 comprises a pressure vessel including the sheath gas and having a controllable valve adjusting the sheath gas pressure in the outer tube 12.

The inventors have found that changes in phase between the gas dynamic nozzle spurts and the probe beam pulses depend on the derivative of the flow rate. To retard the spurt time the flow rate of the liquid is reduced (increasing the interval between spurts) but then is increased again once the desired phase shift has been obtained (bringing the spurt interval back into coincidence with the x-ray pulse interval). Preferably, this complex behavior is controlled by active driving of the spurt formation with the trigger device 24.

The trigger device 24 is adapted for applying an acoustic, optical, electric or electromagnetic pulse to the downstream end of the inner tube 11. Thus, the trigger device 24 applies forces to the liquid by means other than via pressure from the HPLC, pump or the driving sheath gas, e.g. by compression forces created by a strong piezoelectric. transducer, by a stepper-motor driven piston or by a high-voltage pulse. This has the further advantage that complex pressure pulses can be applied to not only push but also pull on the gas dynamic nozzle meniscus to shape its time development. A train of pressure-suction pulses following initial expulsion of the GDVN spurt could be employed, for example, to nullify the oscillations in the hemispherical gas dynamic nozzle drop following "snap-back" of the cusped meniscus, and thereby allow reliable operation at much higher repetition rates.

Since the elongated drop at the tip of the gas dynamic nozzle inner tube 11 clearly becomes unstable at the instant it snaps into the cusped gas dynamic nozzle meniscus, a trigger signal applied just prior to this instant will almost certainly be adequate to trigger the creation of the spurt. Since only a very small excitation is needed under these nearly unstable conditions, a signal from the piezoelectric transducer is sufficient. Moreover, this excitation even can be applied indirectly, either at the nozzle but through the sheath gas envelope or to the liquid supply capillary but well upstream of the gas dynamic nozzle 10.

With a preferred example, the trigger device 24 comprises a stepper-motor driven piston driving the liquid to the inner tube 11. A microstepped IMS linear actuator, e. g. from Schneider Electric (KMLI3CRL23A7-EQ-LD3M040AT), can be used for providing the necessary force and time resolution to drive the piston with the linear displacement profile needed to maintain an average flow rate of about 200 nl/min. Superimposed on this would be a more complex intermittent step sequence to deliver small positive/negative pressure pulses as required to eject a gas dynamic nozzle spurts upon receipt of a trigger signal from the measuring apparatus 200 (directly, or via the tuning unit 21). The internal encoder of the linear actuator may be read in real time to allow fine tuning of the actuator position, speed, and acceleration as needed to adjust flow rate and maintain synchronization with the probe beam pulses 6. Additionally or alternatively, the trigger device 24 comprises a piezoelectric transducer being capable to apply an ultrasound pulse to the inner tube 11. The piezoelectric transducer could be used in conjunction with a miniature check valve or similar tailoring of acoustic impedance to attain the same results. More likely, the optimum engineering solution will combine both, providing an easily controllable constant flow drive by means of a stepper motor and a complex pressure profile for spurt ejection by means of a piezoelectric transducer.

Furthermore, FIG. 3 shows that a monitoring device 25 can be provided according to a preferred embodiment of the invention. With the monitoring device 25, the liquid can be monitored when it is emitted into the exit channel 13 or when is has left the exit aperture 14. As an example, the monitoring device 25 comprises an optical sensor, e. g. a photodiode or a camera device, sensing the occurrence and duration of the spurts of continuous jet sections and the duration of the gaps there between. The monitoring device 25 is connected with the tuning unit 21. A monitoring output signal can be forwarded to the tuning unit 21 for implementing a feedback mechanism. Using the components 25, 21, the feedback mechanism can be provided, to ascertain when the probe beam pulse is actually striking the gas dynamic nozzle spurt.

Advantageously, the inventive injector device 100 can be switched between the conventional continuous mode of operation and the inventive intermittent mode of operation. To this end, the tuning unit 21 is used to adjust the components 23, 24. In particular, the inventive injector device 100 can be remotely switched from intermittent sample flow to continuous liquid, e. g. water, flow and back again, by switching the liquid and altering the gas and liquid flow rates appropriately. This has tremendous advantages for alignment of the liquid free-stream with the probe beam, since searches for spatial overlap and temporal overlap of the two then become separate one-dimensional searches rather than a single two-dimensional search, and accordingly much, much easier (see below).

The injector device 100 is shown in combination with a measuring apparatus 200 in FIG. 3. The measuring apparatus 200 schematically represents the components of a scattering measurement including a probe beam source 210, a detector device 220 and a processor unit 230. The probe beam source 210 is e. g. the LCLS source or a XFEL source. With the probe beam source 210, pulses 6, e. g. X-ray pulses, of a probe beam 5 are emitted to a region of delivery 7, where the pulses 6 interact with the continuous jet sections 4. Alternatively, e.g. as illustrated in FIG. 3, the region of delivery 7 may be chosen to lie at a sufficient distance from the exit aperture that the continuous jet sections 4 has undergone a Rayleigh-Plateau breakup into a linear stream of droplets. The detector device 220 comprises sensors for detecting probe beam radiation scattered at the continuous jet sections 4, as it is known from conventional scattering measurements, and additional sensors as needed to measure and characterize other emanations that are produced, e.g. electrons, ions, atoms, and electromagnetic radiation.

With practical implementations, the scheme of FIG. 3 can be used according to one of the following modes. Firstly, the untriggered, free-running operation mode can be provided. The interval between spurts can be quite constant even without the action of the trigger device 24, but with steady liquid flow rate and sheath gas pressure. Experiments have shown that the overall drift of the untriggered spurt repeat period is only 0.75%. For scattering measurements, the continuous jet sections 4 and probe beam pulses 6 have to be synchronized even with the untriggered operation. To this end, the monitoring output signal from the spurt ejection can be used to trigger the probe beam source 210. If the probe beam source 210 cannot be triggered for technical reasons, synchronization is obtained by the opposite procedure wherein the probe beam source 210 triggers the spurt creation. Thus, secondly, the triggered operation mode can be provided, wherein the regular time pattern of the spurts is controlled by the action of the trigger device 24.

The continuous jet sections 4 and the pulses 6 are spatially and temporally aligned relative to each other. Spatial alignment can be obtained by running the injector device 100 in a conventional continuous flow mode using a sample free liquid, e. g. water. Following the known protocols, the liquid free-stream is displaced while watching for the specific probe beam scattering pattern and e. g. a plasma spot that appear when an X-ray beam is striking the liquid stream. For the temporal alignment, the gas dynamic nozzle 10 can be switched to the triggered intermittent mode, and the phase delay between the trigger pulses supplied from the measuring apparatus 200 and the piezoelectric excitation of the injector is adjusted until the temporal alignment is achieved. The indicator would again be the probe beam scattering pattern and e. g. the plasma spot, as with conventional scattering measurements.

Stroboscopic imaging can be used to synchronize the gas dynamic nozzle spurt with the probe beam pulses, e. g. the XFEL X-ray pulses at the XFEL repetition rate (e. g. 120 HZ for the LCLS source). For the stroboscopic imaging of the intermittent jet, high intensity light flashes of sub-microsecond duration are employed being synchronized to the probe beam pulses and having an adjustable delay time between the illumination pulse and the probe beam pulse. To synchronize the GDVN spurts with the probe beam pulses, the following procedure can be employed: (1) Adjust the delay setting until an image of the GDVN spurt appears on a camera device. Since a stroboscopic image is collected, the camera device is not necessarily a high-speed camera. This delay time is then that by which the GDVN spurt must be advanced (or alternatively retarded) in order to be synchronized with the probe beam pulse. (2) Compute, for the current flow rate, a faster flow rate and duration for that faster flow (or alternatively a slower flow rate and duration for that slower flow) that will bring the GDVN spurt into synchronization with the probe beam pulse. (3) Feed this flow rate and duration to the control device, e. g. to an HPLC control unit, and apply them to the flow. (4) Re-adjust the delay setting until an image of the GDVN spurt appears. (5) Iterate as necessary.

The features of the invention disclosed in the above description, the figures and the claims can be equally significant for realizing the invention in its different embodiments, either individually or in combination.

We claim:

1. A method of producing an intermittent liquid jet, comprising the steps of:

delivering a liquid through a gas dynamic nozzle, which includes an inner tube carrying the liquid, an outer tube carrying a focussing sheath gas, an exit channel and an exit aperture, injecting a stream of the liquid into the exit channel, wherein the liquid is enclosed by the focussing sheath gas in the exit channel, controlling emission of the liquid from the inner tube into the exit channel to produce a periodic, linear intermittent liquid jet including spurts of linear continuous jet sections having a cylindrical form and separated by liquid-free gaps, and output of the intermittent liquid jet through the exit aperture.

2. The method according to claim 1, including the step of setting at least one of a duration of the continuous jet sections, a length of the continuous jet sections, a diameter of the continuous jet sections, a duration of the liquid-free gaps, a length of the liquid-free gaps, and a spurt repeat period T.

3. The method according to claim 2, including at least one of the features the duration of the continuous jet sections is less than 10% of the spurt repetition period T, the length of the continuous jet sections is less than 10% of v*T, where v is a terminal speed of the linear liquid jet, the diameter of the continuous jet sections is below 10 μm, the duration of the liquid-free gaps is greater than 90% of the spurt repetition period T, the length of the liquid-free gaps is greater than 90% of v*T, and the spurt repeat period T is matched to a pulse rate of a separate pulsed probe beam.

4. The method according to claim 2, wherein the controlling step includes at least one of tuning a liquid flow rate of the liquid in the inner tube, tuning a liquid pressure of the liquid in the inner tube, tuning a sheath gas flow rate of the sheath gas in the outer tube, tuning a sheath gas pressure of the sheath gas in the outer tube, providing an inner diameter of the inner tube, providing an axial length of the exit channel, providing a diameter of the exit aperture, and providing an acoustic, optical, or electromagnetic pulse to initiate emission of the liquid spurts from the inner tube.

5. The method according to claim 4, including at least one of the features the liquid flow rate is below 1 μl/min, the liquid pressure is below 6000 psi, absolute, the sheath gas pressure is at between 10 and 3000 psi, the inner diameter of the inner tube is at least 10 μm, the inner diameter of the inner tube is at most 100 μm, the diameter of the exit aperture is at least 10 μm, the diameter of the exit aperture is at most 100 μm, the axial length of the exit channel is at least equal to the diameter of the exit aperture, the axial length of the exit channel is at most twenty times larger than the diameter of the exit aperture, the liquid jet emerges into ambient gas at one atmosphere pressure, the liquid jet emerges into near-vacuum at much less than atmospheric pressure, the gas flows at supersonic speed downstream of the exit aperture, and the gas flows at subsonic speed downstream of the exit aperture.

6. The method according to claim 1, including the steps of monitoring the liquid in the exit channel or after leaving the exit aperture and providing a monitoring output.

7. The method according to claim 6, wherein the controlling step is conducted in dependency on the monitoring output.

8. The method according to claim 1, wherein the controlling step includes an application of acoustic, optical, or electromagnetic pulses triggering the production of the intermittent liquid jet.

9. A method of scattering measurements on samples in a liquid, comprising the steps of:

producing an intermittent liquid jet including spurts of continuous jet sections with a method according to claim 1, irradiating the continuous jet sections or parts thereof with pulses of a probe beam, and measuring scattering of the probe beam from the continuous jet sections or parts thereof.

10. The method according to claim 9, including measuring at least one of the intensity, the energy spectrum and the momentum spectrum of emissions from the intermittent liquid jet resulting from irradiation with the probe beam, including emission of electrons, ions, atoms, and electromagnetic radiation.

11. The method according to claim 9, wherein the intermittent liquid jet and the probe beam pulses are controlled such that each single continuous jet section is irradiated by a single probe beam pulse or by a defined train of multiple probe beam pulses.

12. The method according to claim 11, including a step of controlling a relative phase of the intermittent liquid jet and the probe beam pulses.

13. The method according to claim 12, wherein the relative phase of the intermittent liquid jet and the probe beam pulses are controlled by at least one of tuning a liquid flow rate of the liquid in the inner tube of the gas dynamic nozzle and applying an acoustic, optical, or electromagnetic pulse to the liquid jet.

14. The method according to claim 8, wherein the continuous jet sections are irradiated with the pulses of the probe beam in a region of delivery, and the region of delivery is immediately downstream of the exit aperture.

* * * * *